United States Patent [19]

Hinchman et al.

[11] 4,184,409

[45] Jan. 22, 1980

[54] HYDRAULIC ENGINE

[75] Inventors: Leslie R. Hinchman; Robert B. Hinchman, both of San Benito, Tex.

[73] Assignee: Bessie L. Caldwell, San Benito, Tex.; a part interest

[21] Appl. No.: 875,512

[22] Filed: Feb. 6, 1978

[51] Int. Cl.[2] ..... F01C 9/00; F01L 15/00

[52] U.S. Cl. ..... 91/347; 91/448; 91/466; 60/369; 60/494; 91/218

[58] Field of Search ..... 91/347, 348, 448, 449, 91/466, 218, 339, 344, 345, 350; 60/369, 494; 74/25

[56] References Cited

U.S. PATENT DOCUMENTS

| | | | |
|---|---|---|---|
| 1,374,154 | 4/1921 | Mueller | 60/494 |
| 2,136,986 | 11/1938 | Vernon et al. | 60/369 |
| 2,282,977 | 5/1942 | Mast | 91/219 |
| 3,162,094 | 12/1964 | Toman | 91/347 X |
| 3,451,218 | 6/1969 | Grant | 60/494 X |
| 3,534,631 | 10/1970 | Keller | 60/494 X |
| 3,898,805 | 8/1975 | Good | 60/494 X |

*Primary Examiner*—Edgar W. Geoghegan
*Attorney, Agent, or Firm*—Harvey B. Jacobson; Clarence A. O'Brien

[57] ABSTRACT

A hydraulic engine having a fluid pump for pumping a fluid medium under pressure to a fluid motor connected to the pump for being actuated by the fluid medium under pressure received from the pump. A control system regulates operation of the pump and motor so as to permit appropriate variation of speed of an output shaft of the motor. The fluid motor is a reciprocating motor, the piston of which is connected directly to a mechanism for translating the reciprocating motion into rotary motion, while the reciprocating movement of the pistons simultaneously actuates valves for sequentially directing the fluid medium under pressure to opposite ends of the piston in order to obtain a double-acting piston and cylinder operation.

6 Claims, 7 Drawing Figures

Fig. 2
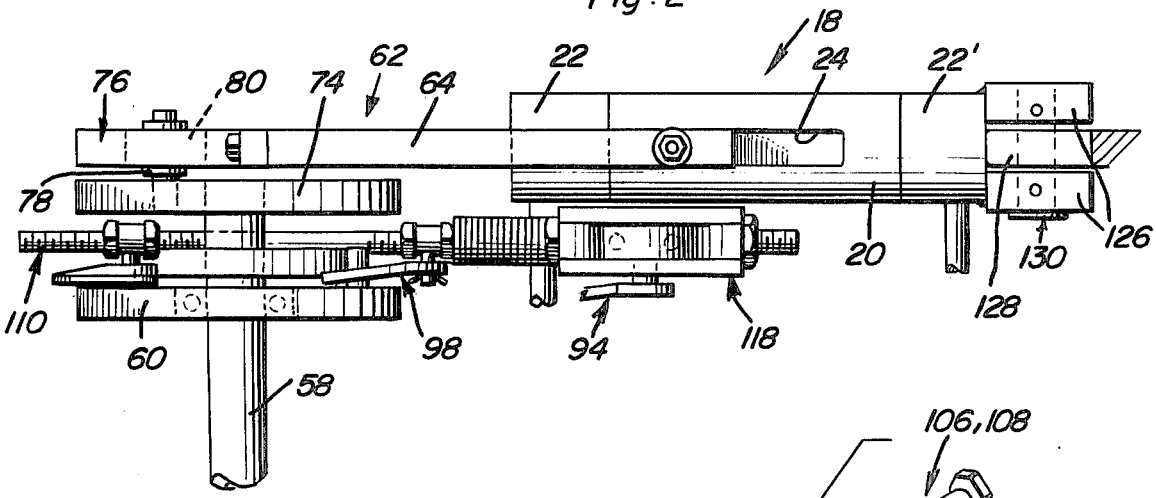
Fig. 3
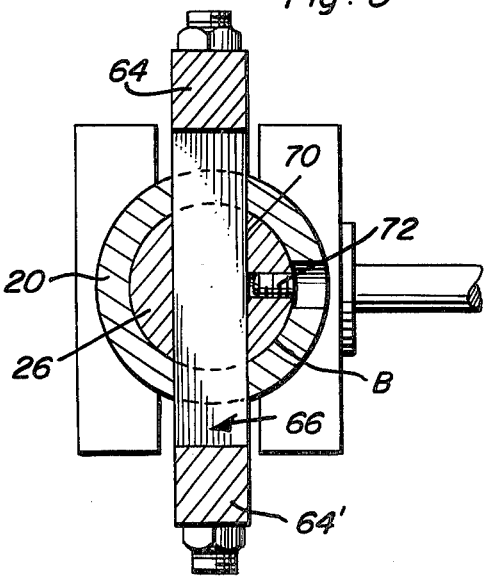
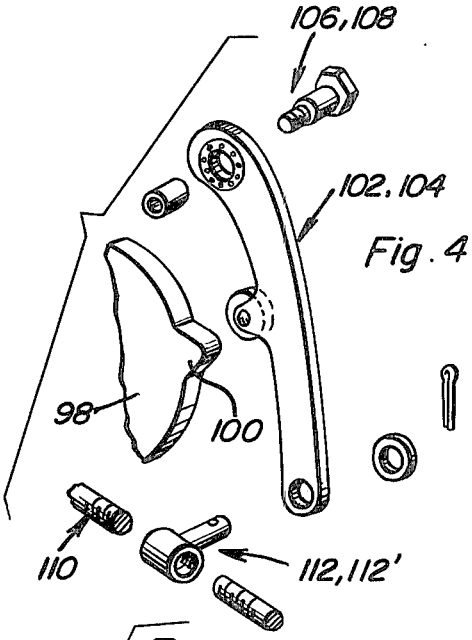
Fig. 4
Fig. 5
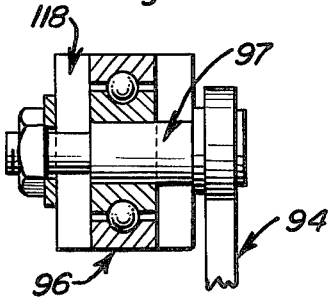
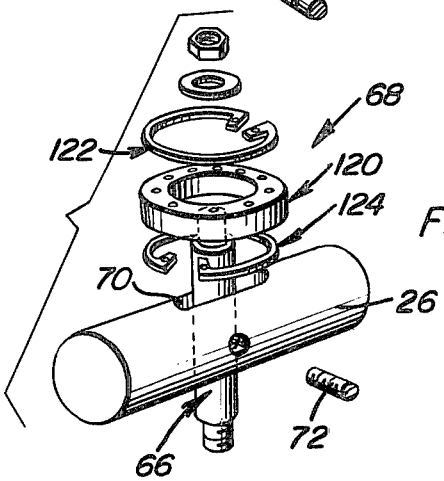
Fig. 6

HYDRAULIC ENGINE

BACKGROUND OF THE INVENTION

1. Field of the Invention

The present invention relates generally to power devices, and particularly to a device utilizing a DC electric motor and pump assembly associated with a hydraulic fluid supply and a reciprocating hydraulic motor including a unique mechanism for translating reciprocating motion of the motor into rotary motion.

2. Description of the Prior Art

Devices utilizing hydraulic motors for converting energy in a pressurized hydraulic liquid to mechanical energy have been used, as have various types of engines and other devices for supplying pressurized hydraulic fluid. While such devices have received some degree of acceptance, the known devices are usually relatively inefficient in converting energy into the desired mechanical output.

Our prior U.S. Pat. No. 4,007,591, issued Feb. 15, 1977, discloses a power device utilizing a housing and rotary assembly receiving pressurized non-compressible liquid from a pump for driving an output shaft which may be employed for many purposes. A bypass control is provided for the pump for varying the output characteristic of the output shaft and a DC electric motor which drives the pump. The electric motor is associated with an electric power system for providing electrical energy to the pump motor, which power system includes an alternator or equivalent charging device, battery assembly, and an inverter and converter associated with one another in a manner to supply sufficient electric energy to the pump motor for driving the pump.

U.S. Pat. No. 2,528,131, issued Oct. 31, 1950, to O. L. Garretson, discloses a hydraulic pumping unit wherein the valves which route the working fluid to an appropriate side of an associated reciprocating piston are actuated by linkage attached to one of the piston rods of the pumping unit. Further, additional examples of fluid engines employing reciprocating pistons can be found in U.S. Pat. Nos: 859,961, issued July 16, 1907 to H. B. Meier; 2,622,372, issued Dec. 23, 1952 to T. M. Moulden; 2,887,955, issed May 26, 1959 to A. B. Owen; and 2,925,806, issued Feb. 23, 1960 to H. Taylor; while U.S. Pat. Nos. 965,820, issued July 26, 1910 to J. Hutchings, discloses the use of an oscillating distributing valve for use with double acting compound steam engines, and the like.

SUMMARY OF THE INVENTION

It is an object of the present invention to provide a hydraulic engine employing a double-acting piston and cylinder assembly wherein the actuation of the valve which sequentially directs the working fluid to either end of the cylinder is carried out in a more efficient and reliable manner than known devices of this kind.

It is another object of the present invention to provide a hydraulic motor employing a reciprocating piston wherein the reciprocating movement of the piston is translated into a rotary output motion in a simple yet efficient manner.

It is still another object of the present invention to provide a hydraulic engine in which the pump thereof is powered by a DC electric motor and provided with a bypass assembly controlling the characteristics of the output shaft of the engine, thus permitting the use of power in remote locations away from conventional sources of electric power, and where the operating characterisitics of a fluid motor are required.

These and other objects are achieved according to the present invention by providing a hydraulic engine having: a fluid pump for pumping a fluid medium under pressure; a fluid motor connected to the pump for being actuated by fluid medium under pressure received from the pump; and a control system for regulating the operation of the pump and motor.

The fluid motor preferably comprises a longitudinally extending cylinder provided with a central bore extending longitudinally of the cylinder, and with a slot communicating with the bore along a part of the longitudinal extent of the cylinder. A piston is slidably disposed within the bore of the cylinder for reciprocating movement along the longitudinal extent of the cylinder, the piston being provided with a projection slidably received in the slot provided in the cylinder. A valve system is connected to the pump and to the cylinder of the motor for forming a separate flow path to either end of the bore provided in the cylinder for sequentially directing fluid medium through the flow path and reciprocating the piston within the cylinder.

A motion translation mechanism is connected to the projection of the piston and to an output shaft of the motor for converting reciprocating movement of the piston into rotary motion of the shaft. This mechanism preferably comprises an elongated member connected to and arranged extending longitudinally from the projection of the piston, which projection is pivotally mounted in a slot provided in the piston for rocking movement relative thereto. A crank is affixed to the output shaft of the motor for rotating the shaft, while a cage is affixed to the aforementioned elongated member and engages a crank pin affixed to the crank and arranged for being moved in a circular path by the cage when the elongated member is reciprocated by the piston.

The valve system advantageously comprises a valve including a block having an inlet and two outlets connected together by passages provided inside of the block, and an actuator arranged in the block for blocking the outlets one at a time. A lever extends from the actuator outside of the block and is engaged by the follower of a coupler device connected to follower members pivotally mounted adjacent the motion translation mechanism and selectively engageable by the lobe of a cam mounted on the output shaft of the motor for rotation therewith. In this manner, the valving action is timed by reciprocation of the piston in an efficient and simple manner.

Another preferred embodiment of a valve system according to the invention includes a pair of collars mounted in spaced relation at the longitudinally spaced ends of the cylinder, each of the collars being provided with an inlet port connected to the pump and an outlet port connected to the cylinder. A longitudinally extending element having longitudinally spaced ends is slidably disposed in the collars, with the element being provided with a slot intermediate the longitudinal extent thereof for receiving a projection connected o the piston extending through a slightly longer slot provided in the piston for creating a lost motion arrangement with respect to the longitudinally extending element in order to reciprocate the element as a fur ion of the reciprocating movement of the piston. Adjacent passages are provided at either end of the longitudinally extending element for alternatively aligning with at least one of the associated inlet port and outlet port, with one of the passages being straight through the element, transversely of the longitudinal extent thereof, so as to pass between the inlet port and the outlet port, and the other of the passages being a right angle passage so as to vent the adjacent portion of the cylinder outwardly of the adjacent end of the longitudinally extending element.

The pump has associated therewith a speed control valve inserted between an outlet of the pump and the fluid motor for controlling the speed of the fluid motor by diverting at least a portion of the fluid under pressure generated by the pump from the fluid motor and back to a sump, and the like.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2 is a fragmentary, schematic, top plan view showing the device of FIG. 1.

FIG. 3 is an enlarged, fragmentary, sectional view taken generally along the line 3—3 of FIG. 1.

FIG. 4 is a fragmentary, exploded, perspective view showing a portion of a motion translating mechanism according to the present invention.

FIG. 5 is an enlarged, fragmentary sectional view taken generally along the line 5—5 of FIG. 1.

FIG. 6 is an exploded, perspective view showing a portion of a piston assembly for the device seen in FIGS. 1–5.

DESCRIPTION OF THE PREFERRED EMBODIMENTS

Figure 1:
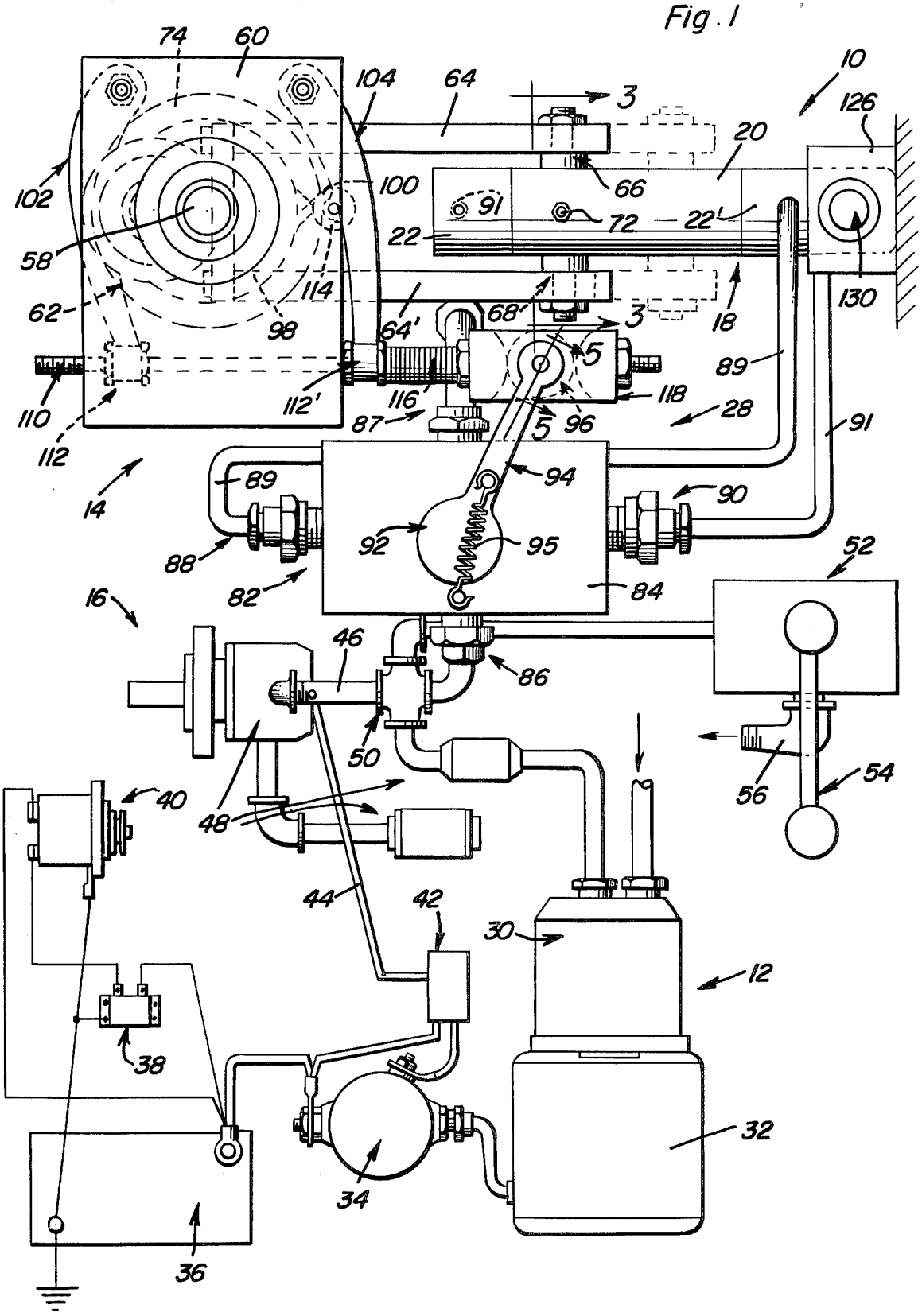
FIG. 1 is a schematic diagram showing a first embodiment of a hydraulic engine according to the present invention.

Referring now more specifically to FIGS. 1–6 of the drawings, hydraulic engine 10 according to the present invention includes a fluid pump assembly 12 for pumping a fluid medium under pressure to a motor assembly 14. The latter is connected to assembly 12 for actuation by a fluid medium, such as a conventional hydraulic fluid, received under pressure from a pump of assembly 12, with the operation of engine 10 being regulated by a control system 16 associated with assemblies 12 and 14.

Motor assembly 14 includes a cylinder 18 provided with a longitudinally extending central bore and formed by a centrally disposed body portion surrounded by a pair of removable end caps 22 and 22'. At least one and preferably the illustrated plurality of slots 24 are provided in body portion 20 so as to communicate with bore B along a part of the longitudinal extent of the longitudinally extending cylinder 18. A piston 26 is slidably disposed within bore B of cylinder 18 for reciprocating movement along the longitudinal extent of cylinder 18, with piston 26 being provided with a projection slidably received in the opposed slots 24 provided in body portion 20. Connected to the pump assembly 12 and the cylinder 18 of motor assembly 14 is a valve system 28 which forms separate flow paths for the fluid medium under pressure to either end of cylinder 18 for sequentially directing the fluid medium through the flow path and into bore B for reciprocating piston 26 within cylinder 18.

Pump assembly 12 includes a fluid pump 30 of conventional construction and connected directly to, for actuation by, a conventional DC electric motor 32. The latter is connected through a conventional on-off switch 34 to an appropriate storage battery 36, and the like, for permitting motor 32 to be energized in a remote location. Battery 36 can be charged as by means of a conventional automotive electrical system including a regulator 38 and an alternator 40. A suitable high-limit cut-off switch 42 is directed to battery 36, as through switch 34, and by means of a hose 44 to a pipe 46 which in turn connects a multi-station foot-operated switch 48 to a conventional pipe junction 50 inserted in the line connecting pump 30 to the motor assembly 14, for causing a shutdown of the pump assembly should the pressure in the system exceed a predetermined safe value.

Pump assembly 12 also includes a speed control valve 52 inserted between pump 30 and motor assembly 14 for controlling the speed of the motor assembly 14 by diverting at least a portion of the fluid under pressure delivered by pump 30 back to a sump, and the like, associated with the engine. This valve 52 has a hand-operable lever 54 which selectively permits fluid to be passed from the valve 52 through a drain 56 to appropriate destination.

Motor assembly 14 includes an output shaft 58 journaled for rotation on a plate 60 partially forming a support for the motor assembly 14. A motion translation mechanism 62 is connected to the projection provided on piston 26 and to shaft 58 for converting te reciprocating movement of piston 26 into rotary motion of shaft 58.

Motion translation mechanism 62 includes a pair of elongated members in the form of bars 64 and 64' each connected to and extending longitudinally from the longitudinal ends of a cross pin 66 which forms the projection of piston 26. This cross pin 66, which is attached to bars 64, 64' as by bearing assembly 68 so as to permit pivotal movement of bars 64, 64', is pivotally mounted in a slot 70 provided in piston 26 for rocking movement relative to piston 26 and permitting the bars 64, 64' to move in an oscillating loop. An appropriate set screw 72 can be employed for retaining cross pin 66 within slot 70. A crank wheel 74 is affixed to shaft 58 for rotating the shaft, with crank 74 itself being rotated by an arrangement which includes a cage 76 affixed to the end of rods 64, 64' spaced from the attachment of the latter to cross pin 66, and a crank pin 78 affixed to crank wheel 74 and arranged engaged in cage 76 for being moved in a circular path when the bars 64, 64' reciprocate with piston 26. A suitable bearing 80 is advantageously arranged within cage 76 for receiving in the center aperture thereof crank pin 78 in a manner which greatly reduces friction in the arrangement.

Valve system 28 includes a valve 82 having a block 84 provided with an inlet 86, an exhaust 87, and a pair of outlets, with an outlet 88 being connected to one end of cylinder 18 by a line 89, and the other outlet 90, being connected to the other end of cylinder 18 by a line 91. An actuator 92 of conventional construction is arranged in block 84 for alternately connecting outlets 88 and 90 one at a time to inlet 86 and exhaust 87, with a lever 94 being arranged extending from actuator 92 outside of block 84 for reciprocating movement in a manner discussed above in order to actuate valve 82. A spring 95 is fastened to block 84 and to lever 94 for biasing lever 94 in one of two positions over center of the lever 94. As can be seen from FIG. 5, a conventional ballbearing 96, and the like, is mounted on a spindle 94 at the end of lever 94 spaced from block 84 for providing a low friction cam follower employed in a manner to be described below.

A cam 98 is affixed to shaft 58 through plate 60 for rotation therewith, with cam 98 being provided with a single lobe 100. A pair of follower members 102 and 104 are pivotally mounted as by pins 106 and 108 on the plate 60 which forms a support for the translation mechanism and shaft 58 as mentioned above. These follower members 102 and 104 are arranged for sequentially being pivoted by engagement therewith of lobe 100 of cam 98, with a coupler arrangement including a screw threaded rod being connected to the follower members 102 and 104 at the free ends thereof as by the illustrated nut portions 112 and 112' which terminate the members 102 and 104. The use of a screw threaded rod 110 permits adjustment of the follower members 102, 104, which follower members 102, 104 are provided intermediate the length thereof with rollers 114, only one of which is seen in FIG. 1, for reducing friction between the follower members 102 and 104 and the cam 98. A plurality of spacers 116 are arranged between the nut portion 112' and a follower 118 provided with a central opening in which the bearing 96 is received, so that lever 94 will be reciprocated by reciprocating movement of threaded rod 110 as cam 98 is rotated on shaft 58. In this manner, valve 82 will sequentially direct the operating fluid medium between the outputs 88 and 90 in order to reciprocate piston 26.

As can be seen from FIG. 6, each of the bearing assemblies 68 includes a conventional ball roller bearing 120 which is received in a mating aperture provided in an associated end of a corresponding one of the bars 64, 64', and is retained in such mating opening by a pair of conventional lock rings 122 and 124. A washer and nut is employed to hold the entire assembly on a screw threaded end of cross pin 66.

The end of cylinder 18 formed by the end cap 22' is advantageously supported on a wall, frame, and the like, by an arrangement including a pair of spaced mounting blocks 126 forming a groove for receiving a tongue 128 affixed to and arranged extending away from the outer end surface of cap 22'. A suitable pin 130 can be arranged through mating apertures provided in mounting block 126 and tongue 128 for pivotally mounting the entire arrangement and permitting adjustment of motor assembly 14 relative to its supporting structure.

Figure 7:
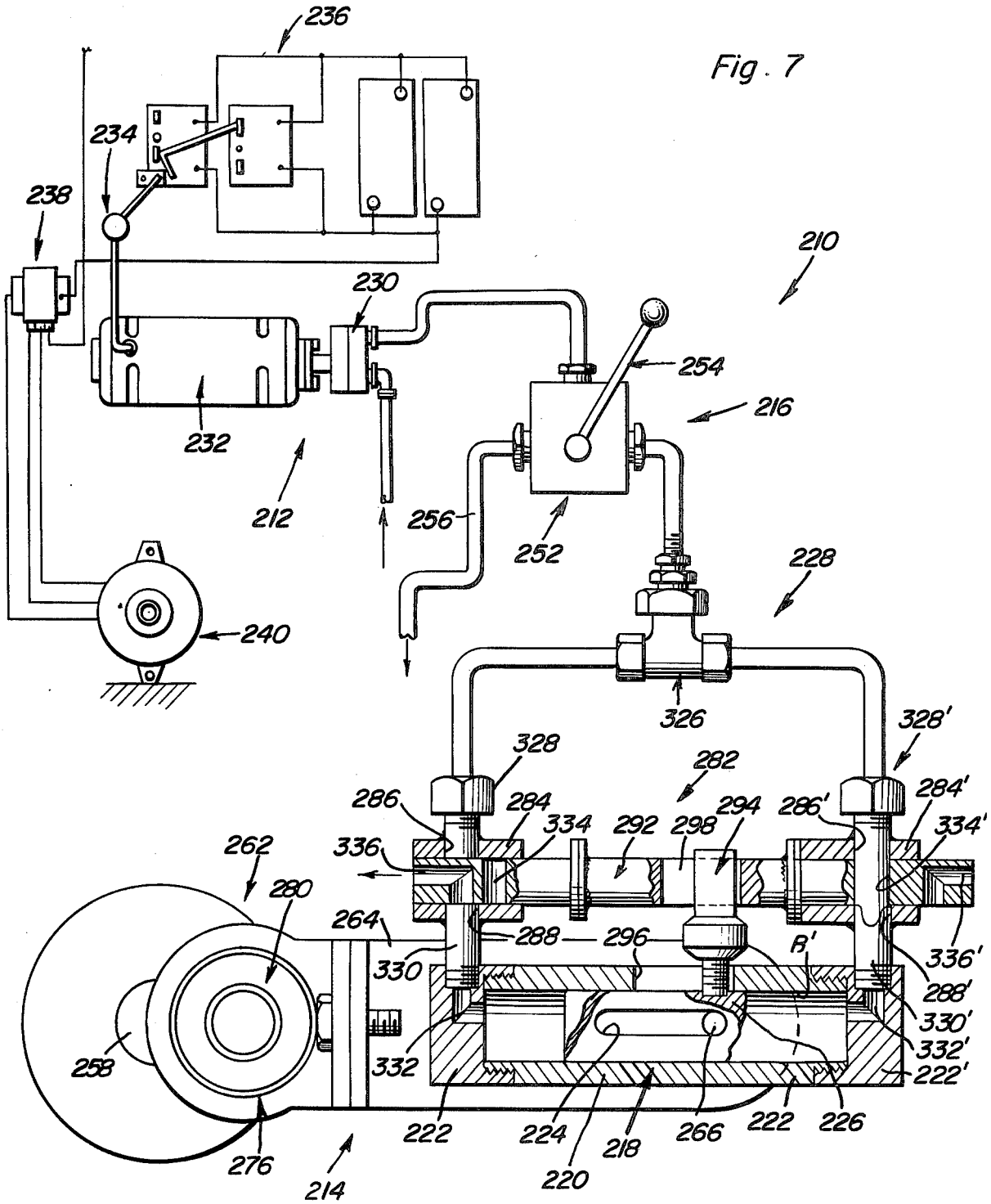
FIG. 7 is a schematic diagram similar to FIG. 1, but showing a second preferred embodiment of the hydraulic engine according to the present invention.

Referring now more specifically to FIG. 7 of the drawings, a second embodiment of hydraulic engine, designated 210, is illustrated, which engine 210 includes a pump assembly 212, motor assembly 214, and control system 216 arranged in a manner similar to the assemblies 12 and 14 and control system 16 of engine 10 described above.

Motor assembly 214 includes a cylinder 218 constructed in a manner similar to that of cylinder 18 and including a central body portion 220 bracketed by a pair of movable end caps 222 and 222', with the cylinder 218 extending longitudinally and having a bore B' extending longitudinally therewith through body portion 220. A pair of opposed slots 224 are provided in body portion 220 for a reason which will become apparent below.

A piston 226 is slidably disposed within bore B' of cylinder 218, with a fluid medium under pressure being distributed from pump assembly 212 to either end of cylinder 218 by a valve system 228.

Pump assembly 212 is similar to assembly 12, and is driven by a conventional DC electric motor 232 attached by means of a switch 234 to a battery bank 236, which batteries can be charged through a suitable system including a conventional regulator 238 and alternator 240. As mentioned above with regards to engine 10, engine 210 can be driven by any suitable DC electrical system, such as those found on motor vehicles, and the like.

A speed control valve 252 is inserted between pump 230 and motor assembly 214 for controlling the speed of assembly 214 in a manner similar to valve 52 by diverting fluid under pressure from assembly 14 and returning same to a sump, and the like, employed in conjunction with engine 210. This valve 252 includes a manually-operable lever 254 which can selectively open valve 252 and direct fluid medium under pressure to a return line 256.

An output shaft 258 is journaled in a manner similar to shaft 58, and is driven by a motion translation mechanism 262 virtually identical to mechanism 62.

Motion translation mechanism 262 includes an elongated member 264 connected to piston 226 as by suitable cross pin 266, and carries the outer end thereof of a cage 276 including a bearing 280 which engages with a crank pin in the manner of mechanism 62. Since the construction operation of mechanism 262 is essentially identical to that of mechanism 62, the motion translation mechanism 262 will not be described in greater detail herein.

Valve system 228 of engine 210 includes a valve 282 comprising a pair of collars 284 and 284' mounted in spaced relation at longitudinally spaced ends of cylinder 218, with each of the collars 284 and 284' including an inlet 286, 286' and an outlet 288, 288', respectively, with the outlets being in communication with bore B' of cylinder 218. A longitudinally extending valve element 292 which has longitudinally spaced ends, is slidably disposed within collars 284, 284', and is moved in a reciprocating manner by a projection 294 connected to piston 226 and arranged extending out of body portion 220 of cylinder 218 through a slot 296 provided in body portion 220. This projection 294 is received in a slot 298 provided intermediate the longitudinal extent of element 292 so as to provide some lost motion in order to move element 292 only the distance required for actuation of valve 282, which distance is substantially less than the stroke of piston 226. A suitable tee 326 and lines associated therewith connects each of the inlets 286, 286' to the speed control valve 252, with conventional fittings 328 and 328' making the actual connection of the lines diverging from tee 326 to the collars 284 and 284'. Likewise, conventional nipples 330 and 330' connect the outlets 288 and 288' of collars 284 and 284' to respective ends of cylinder 218. Provided within each of the end caps 222 and 222' of cylinder 218 are right-angle passages 332 and 332' for connecting the outlets 288 and 288' of collars 284 and 284' to bore B' of cylinder 218, while a pair of passages 334, 334' and 336, 336' are provided in each of the longitudinally spaced ends of element 292. The passages 334, 334' are straight through passages which place the outlets 288, 288' in communication with the inlets 286, 286 of the respective collars 284, 284', while the passages 336, 336' are right-angle passages opening in the end surfaces of element 292 so as to vent the bore B' to atmosphere.

In operation, the valve system 28 of the embodiment of the invention illustrated in FIG. 7 will sequentially place an associated end of cylinder 218 either in communication with a source of fluid medium under pressure or vent it to atmosphere depending on whether the passage 334, 334' or 336, 336' is placed in operable position with an associated outlet 288, 288'. That is, as seen in FIG. 7, collar 284 is causing the left-hand end of cylinder 218 to vent to atmosphere, while collar 284' is causing fluid pressure to be passed through passage 334' and 332' into the righthand end of cylinder 218 in order to force piston 226 toward the left as seen in the Figure. Such movement to the left of piston 226 will cause the elongated member 264, which is connected to piston 226 by cross pin 266, to be moved to the left also along the extent of slots 224.

SUMMARY

As will be appreciated from the above description and from the drawings, a hydraulic engine according to the present invention provides an efficient and versatile manner of achieving desirable hydraulic motor action in a remote location where only DC electricity may be available. Such a DC power source may be that commonly found in a motor vehicle, and the like, used to transport the engine to a site where the use of the engine may be required.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as set forth in the claims which follow.

What is claimed as new is as follows:

1. A hydraulic engine, comprising, in combination:

fluid pump means pumping a fluid medium under pressure;

fluid motor means connected to the pump means for being actuated by fluid medium under pressure received from the pump means, said fluid motor means comprising, in combination:

a longitudinally extending cylinder provided with a central bore extending longitudinally of the cylinder and with a slot communicating with the bore along a part of the longitudinal extent of the cylinder; a piston slidably disposed within the bore of the cylinder for reciprocating movement along the longitudinal extent of the cylinder, the piston being provided with a projection slidably received in the slot provided in the cylinder; valve means connected to the pump means and to the cylinder and forming separate flow paths to either end of the bore provided in the cylinder for sequentially directing fluid medium through the flow path and reciprocating the piston within the cylinder; a rotatably mounted output shaft; and motion translation means connected to the projection of the piston and to the output shaft for converting reciprocating movement of the piston into rotary motion of the shaft;

control means for regulating the operation of the pump means and the motor means;

wherein the valve means comprises, in combination: a valve including a block having an inlet and two outlets, and an actuator arranged in the block for blocking the outlets one at a time, a lever extending from the actuator outside of the blocks; a cam affixed to the shaft for rotation therewith; support journaling the output shaft; a pair of elongated follower members pivotally mounted in spaced relation on the support and arranged for sequentially being pivoted by engagement of the cam; coupler means connected to the members and to the lever of the actuator for oscillating the lever and sequentially directing fluid medium from one of the outlets at a time; and exhaust means connected to said valve for connecting the blocked outlet to an exhaust port.

2. A hydraulic engine, comprising, in combination:

fluid pump means pumping a fluid medium under pressure;

fluid motor means connected to the pump means for being actuated by fluid medium under pressure received from the pump means, said fluid motor means comprising, in combination: a longitudinally extending cylinder provided with a central bore extending longitudinally of the cylinder and with a slot communicating with the bore along a part of the longitudinal extent of the cylinder; a piston slidably disposed within the bore of the cylinder for reciprocating movement along the longitudinal extent of the cylinder, the piston being provied with a projection slidably received in the slot provided in the cylinder; valve means connected to the pump means and to the cylinder and forming separate flow paths to either end of the bore provided in the cylinder for sequentially directing fluid medium through the flow path and reciprocating the piston within the cylinder; a rotatably mounted output shaft; and motion translation means connected to the projection of the piston and to the output shaft for converting reciprocating movement of the piston into rotary motion of the shaft; control means for regulating the operation of the pump means and the motor means;

wherein the valve means comprises, in combination: a pair of collars mounted in spaced relation at longitudinally spaced ends of the cylinder, each of the collars being provided with an inlet port connected to the pump means and an outlet port connected to the cylinder; and a longitudinally extending element having longitudinally spaced ends and slidably disposed in the collars, the element being connected to the piston for movement thereby, and the ends of the element being provided with adjacent passages, one of the passages being straight through the element transversely of the longitudinal extent thereof and the other of the passages defining a right-angle path opening in an associated end surface of the element to exhaust.

3. A hydraulic engine, comprising, in combination:

fluid pump means pumping a fluid medium under pressure;

fluid motor means connected to the pump means for being actuated by fluid medium under pressure received from the pump means, said fluid motor means comprising, in combinaion: a longitudinally extending cylinder provided with a central bore extending longitudinally of the cylinder and with a slot communicating with the bore along a part of the longitudinal extent of the cylinder; a piston slidably disposed within the bore of the cylinder for reciprocating movement along the longitudinal extent of the cylinder, the piston being provided with a projection slidably received in the slot provided in the cylinder; valve means connected to the pump means and to the cylinder and forming separate flow paths to either end of the bore provided in the cylinder for sequentially directing fluid medium through the flow path and reciprocating the piston within the cylinder; a rotatably mounted output shaft; and motion translation means connected to the projection of the piston and to the output shaft for converting reciprocating movement of the piston into rotary motion of the shaft; control means for regulating the operation of the pump means and the motor means;

wherein the motion translation means comprises, in combination: an elongated member connected to and arranged extending longitudinally from the projection of the piston, which projection is pivotally mounted in a slot provided in the piston for rocking movement relative thereto: a crank affixed to the output shaft for rotating the shaft; a cage affixed to the elongated member; and a crank pin affixed to the crank and arranged engaging the cage for being moved in a circular path when the elongated member reciprocates with the piston in imparting a rotary motion to the crank and associated output shaft.

4. A structure as defined in claim 3, wherein the valve means comprises, in combination:

a valve including a block having an inlet and two outlets, and an actuator arranged in the block for blocking the outlets one at a time, a lever extending from the actuator outside of the blocks;

a cam afixed to the shaft for rotation therewith;

support journaling the output shaft;

a pair of elongated follower members pivotally mounted in spaced relation on the support and arranged for sequentially being pivoted by engagement of the cam;

coupler means connected to the members and to the lever of the actuator for oscillating the lever and sequentially directing fluid medium from one of the outlets at a time; and exhaust means connected to said valve for connecting the blocked outlet to an exhaust port.

5. A structure as defined in claim 3, wherein the valve means comprises, in combination:

(a) a pair of collars mounted in spaced relation at longitudinally spaced ends of the cylinder, each of the collars being provided with an inlet port connected to the pump means and an outlet port connected to the cylinder; and (b) a longitudinally extending element having longitudinally spaced ends and slidably disposed in the collars, the element being connected to the piston for movement thereby, and the ends of the element being provided with adjacent passages, one of the passages being straight through the element transversely of the longitudinal extent thereof and the other of the passages defining a right-angle path opening in an associated end surface of the element to exhaust.

6. A structure as defined in claim 3, wherein the pump means includes a pump assembly and a speed control valve inserted between the pump assembly and the fluid motor means for controlling the speed of the fluid motor means by diverting fluid under pressure from the fluid motor means.

* * * * *